United States Patent [19]

Gay

[11] Patent Number: 4,716,631

[45] Date of Patent: Jan. 5, 1988

[54] PIN FOR WRIST-WATCH

[75] Inventor: Jacques H. Gay, Geneva, Switzerland

[73] Assignee: Gay Freres S.A., Switzerland

[21] Appl. No.: 734,452

[22] Filed: May 15, 1985

[30] Foreign Application Priority Data

May 25, 1984 [CH] Switzerland ..... 2580/84

[51] Int. Cl.[4] ..... A44C 5/14

[52] U.S. Cl. ..... 24/265 B; 16/229; 16/381; 411/347; 411/516

[58] Field of Search ..... 24/265 B, 265 WS; 411/347, 348, 356, 511, 516; 16/229, 381; 224/167; 63/8, 9

[56] References Cited

U.S. PATENT DOCUMENTS

| | | | |
|---|---|---|---|
| 1,516,223 | 11/1924 | Wadsworth | 24/265 B |
| 2,507,701 | 5/1950 | Feiner et al. | 24/265 B |
| 2,510,938 | 6/1950 | Boots | 24/265 B |
| 2,765,108 | 10/1956 | Doerwald | 63/8 X |
| 2,904,825 | 9/1959 | Kessler et al. | 16/381 |
| 2,990,678 | 7/1961 | Comte | 24/265 WS X |
| 4,288,892 | 9/1981 | Mardirossian | 24/265 WS X |
| 4,536,922 | 8/1985 | Brassond | 24/265 B |

FOREIGN PATENT DOCUMENTS

| | | | |
|---|---|---|---|
| 1124755 | 3/1962 | Fed. Rep. of Germany | 24/265 WS |
| 912561 | 8/1946 | France | 24/265 B |
| 2282241 | 3/1976 | France | 24/265 WS |
| 239046 | 12/1945 | Switzerland | 24/265 B |
| 419694 | 3/1967 | Switzerland | 24/265 WS |

*Primary Examiner*—Kenneth J. Dorner
*Assistant Examiner*—James R. Brittain, Jr.
*Attorney, Agent, or Firm*—Kane Dalsimer Kane Sullivan & Kurucz

[57] ABSTRACT

The pin incorporates a cylindrical body in which two sliding components are mounted, the two sliding components being intended to engage in lug holes or between the cheeks of a bracelet link or of a fastener. The sliding components have a threaded portion which is intended to be screwed into the lug holes so as to ensure locking of the pin. The cylindrical sliding components may either be held apart by a spring, or may be screwed into the tube.

3 Claims, 5 Drawing Figures

PIN FOR WRIST-WATCH

The subject of the present invention is a pin for a wrist-watch, either for fixing the bracelet to the case, or for joining together two components of the bracelet, incorporating a cylindrical body at the ends of which two cylindrical components are mounted which are capable of moving axially in the cylindrical body and are intended to engage in lug holes or between the cheeks of a bracelet link.

Pins with telescopic ends have been known for a considerable time, and are known as spring pins, consisting of a tubular cylindrical body containing a spring working in compression and holding apart two cylindrical pivots which are housed in cylindrical holes in the lugs of the watch cases. These pins have the advantage of being able to be introduced between the lugs by pushing the pivots into the tubular body, these pivots engaging automatically in the cylindrical lug holes when they reach a position opposite the latter. Such pins are not axially locked.

The aim of the present invention is to construct a pin which is lockable axially, so that once placed in position, it cannot be removed by axial compression, and the compression spring may consequently be eliminated.

The pin according to the invention is characterised in that the said cylindrical components have a threaded portion which is intended to ensure axial locking of the pin by rotation of the cylindrical components relative to the said body, their outer ends being shaped so as to be capable of being driven in rotation by a screwdriver.

The threaded portions may be situated either outside or inside the cylindrical body of the pin.

The accompanying drawing shows by way of example four embodiments of the invention.

Figure 1:
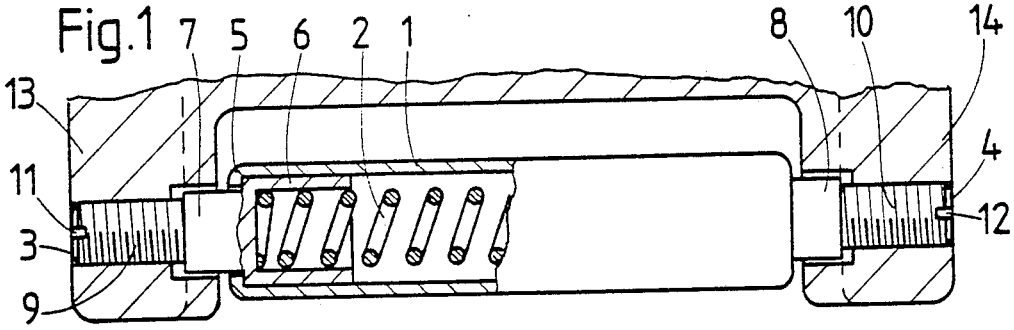
FIG. 1 is a partially sectioned view of a first embodiment.

The pin shown in FIG. 1 incorporates a cylindrical tube 1 containing a helical spring 2 working in compression and holding two cylindrical components 3 and 4 apart from one another, the cylindrical components 3 and 4 being held in abutment against the ends of the tube 1 by a crimping 5. Guidance of the cylindrical components 3 and 4 inside the tube 1 is provided by a cylindrical tubular extension 6 of these components. The cylindrical components 3 and 4 each have a first smooth cylindrical portion 7 and 8, respectively, and a threaded portion 9 and 10, respectively, whose diameter is smaller than that of the portions 7 and 8. The ends of these threaded portions 9 and 10 are provided with a screw slot 11 and 12, respectively. For mounting between the two lugs 13 and 14 of a watch case provided with tapped holes, for example, the cylindrical components 3 and 4 are first pushed inside the tube 1, as for a normal spring pin, so as to be able to introduce the pin between the lugs 13 and 14. Once opposite the lug holes, the components 3 and 4 are screwed into the lug holes by means of a screwdriver. The cylindrical portions 7 and 8 may either be engaged in a smooth portion of the pin holes, or may come into abutment against the outside surface of a lug which is narrower than that shown.

Figure 2:
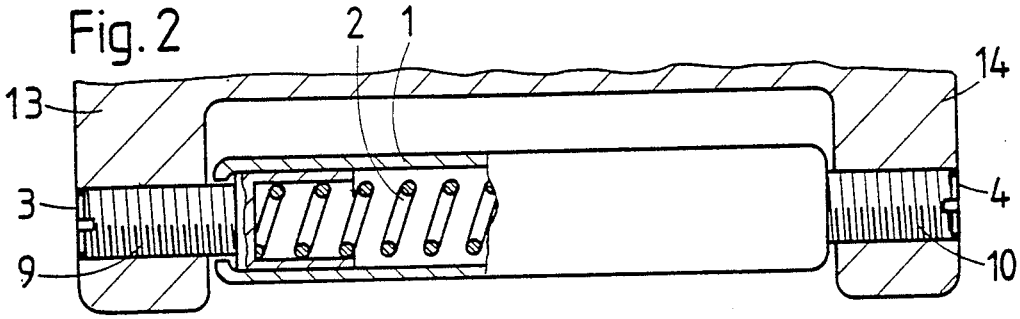
FIG. 2 is a partially sectioned view of a second embodiment.

FIG. 2 shows a variant of construction of the embodiment shown in FIG. 1 in which the cylindrical components are threaded over the whole of their length outside the tube 1.

Figure 3:
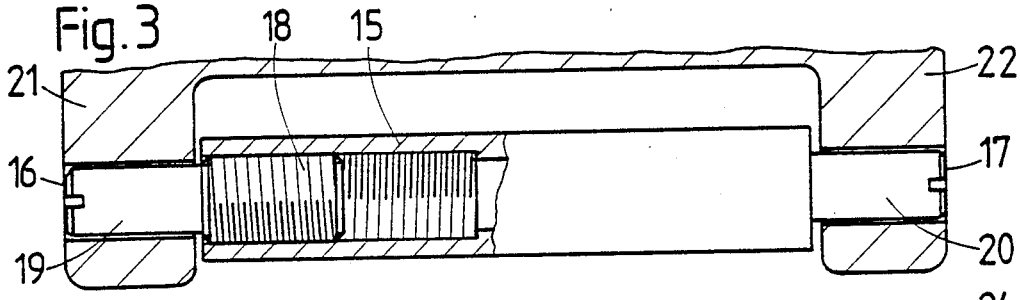
FIG. 3 is a partially sectioned view of a third embodiment.

FIG. 3 shows a pin consisting of a tapped tube 15 into which two cylindrical components 16 and 17 are screwed by a threaded portion 18. The projecting portions 19 and 20, respectively, of the cylindrical components 16 and 17 are smooth and of smaller diameter than that of the threaded portion 18. This pin without a spring may be mounted in place of a normal spring pin between two normal lugs 21 and 22. For this purpose, the cylindrical components 16 and 17 are first retracted by screwing them inside the tube 15, then the pin is positioned between the lugs 21 and 22 and the components 16 and 17 are unscrewed by means of a screwdriver in such a way as to cause their smooth cylindrical portions 19 and 20, respectively, to enter the lug holes.

In the three embodiments described above, it is possible to dimension the cylindrical components of the pin in such a way that the screw slot may be entirely situated outside the lugs so that it is possible to remove the projecting end and with it the screw slots, by grinding, for example, in such a way as to block off the pin while at the same time causing the screw slot to disappear and polishing the ends of the pin.

Figure 4:
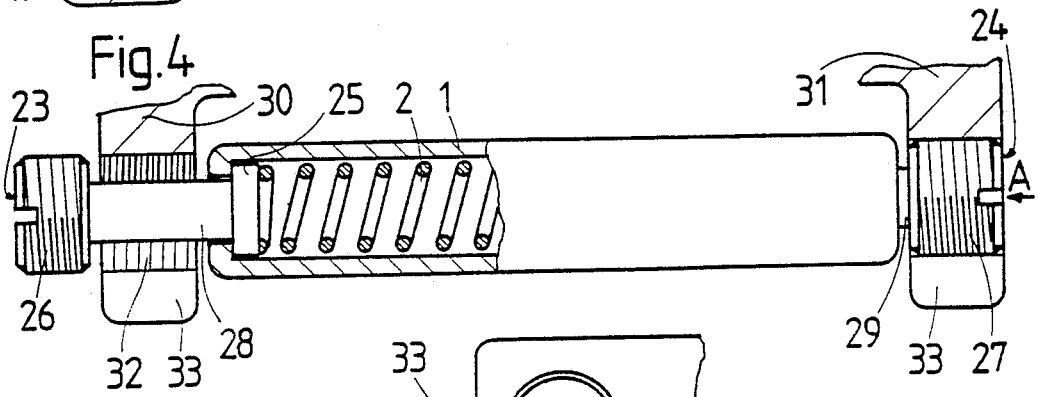
FIG. 4 is a partially sectioned view of a fourth embodiment.
Figure 5:
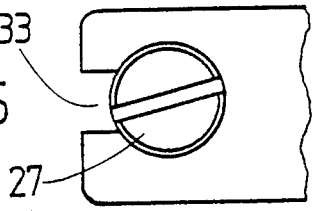
FIG. 5 is an axial view in the direction of the arrow A of this fourth embodiment.

FIGS. 4 and 5 show a fourth embodiment which may be considered as a variant of the first embodiment. The fourth embodiment again incorporates a tube 1 housing a spring 2 which holds apart two cylindrical components 23 and 24, each provided with an inner end in the form of a piston 25 which is capable of sliding in the tube 1. The cylindrical components are each provided with a threaded cylindrical head 26 and 27, respectively, connected to the inner piston 25 by a smooth cylindrical portion 28 and 29, respectively, whose diameter is essentially smaller than the diameter of the heads 26 and 27, for example equal to half the diameter of these heads, and whose length is such that in the free condition, the distance between each of the heads and the corresponding end of the tube 1 is greater than the thickness of the lugs 30 and 31 which are intended to accept this pin. Each of these lugs has a tapped hole 32 communicating radially with a radial slot 33 whose width is just sufficient to allow free passage of the cylindrical portion 28 and 29, respectively, of the pin.

In order to fix this pin to the lugs 30 and 31, this pin is first introduced into the slots 33 by the cylindrical portions 28 and 29, that is to say without compressing the spring 2. This position is shown in the left hand portion of FIG. 4. It is then only necessary to screw the heads 26 and 27 into the holes 32 in order to fix and to lock the pin axially. This final position is shown in the right hand portion of FIG. 4.

In the above description, the subject of the invention is described throughout in relation to the lugs of a case, but clearly other components of the wrist-watch may be involved, such as bracelet links or a fastener.

What is claimed is:

1. Pin for a wrist-watch comprising:

a cylindrical body having two cylindrical components at its ends, said cylindrical components are moveable axially in the cylindrical body so as to engage in lug holes such as between the cheeks or lugs of said wrist-watch, said cylindrical components have a threaded portion which is intended to ensure axial locking of the pin by rotation of the cylindrical components relative to said body, said cylindrical components having outer ends being shaped so as to receive a screwdriver for said rotation, said cylindrical components are mounted so as to slide and are held apart by a compression spring, wherein the portion of the cylindrical components situated outside the tubular body is threaded over at least a portion of its length.

2. Pin for a wrist-watch as claimed in claim 1, wherein the portion of the cylindrical components situated outside the tubular body has a smooth portion and a threaded cut portion.

3. Pin for a wrist-watch comprising:

a cylindrical body having two cylindrical components at its ends, said cylindrical components are moveable axially in the cylindrical body so as to engage in lug holes such as between the cheeks or lugs of said wrist-watch, said cylindrical components have a threaded portion which is intended to ensure axial locking of the pin by rotation of the cylindrical components relative to said body, said cylindrical components having outer ends being shaped so as to receive a screwdriver for said rotation, said cylindrical components have a threaded head and a smooth intermediate portion whose diameter is smaller than the diameter of the head, the distance between one end of said cylindrical body of said pin and the threaded head fixed at this end, is less than the distance between the cheeks or lugs of said wrist-watch, each cheek or lug having a slot whose width is greater than the diameter of the said intermediate portion, opening radially into a tapped hole into which the head of the pin is screwed while compressing a compression spring.

* * * * *